US006450358B1

(12) United States Patent
Berro

(10) Patent No.: US 6,450,358 B1
(45) Date of Patent: Sep. 17, 2002

(54) HYGIENIC BEVERAGE CAN ATTACHMENT

(76) Inventor: Carlo Berro, 1536 W. First St., San Pedro, CA (US) 90732

( * ) Notice: Subject to any disclaimer, the term of this patent is extended or adjusted under 35 U.S.C. 154(b) by 0 days.

(21) Appl. No.: 09/764,386

(22) Filed: Jan. 22, 2001

(51) Int. Cl.[7] ..... A47G 19/22; B65D 51/20

(52) U.S. Cl. ..... 220/258.2; 220/258.5; 220/254.7; 220/716; 220/780

(58) Field of Search ..... 220/254, 256, 220/258, 703, 705, 711, 713, 716, 729, 730, 731, 906, 780, 254.7, 258.1, 258.2, 258.3, 258.5; 222/567, 570

(56) References Cited

U.S. PATENT DOCUMENTS 2,839,229 A * 6/1958 Scheswohl ..... 222/570
3,197,089 A * 7/1965 Michael ..... 222/570
4,054,205 A * 10/1977 Blow, Jr. et al. ..... 220/716
4,679,702 A * 7/1987 Maccarone et al. ..... 222/570
4,703,873 A * 11/1987 Geren ..... 220/254
4,752,016 A * 6/1988 Eads ..... 220/258
4,790,444 A * 12/1988 Terzi ..... 220/256
4,938,379 A * 7/1990 Kellner ..... 220/258
6,073,797 A * 6/2000 Barous ..... 220/716

* cited by examiner

*Primary Examiner*—Nathan J. Newhouse
(74) *Attorney, Agent, or Firm*—Charles H. Thomas

(57) ABSTRACT

A hygienic beverage can attachment is formed as a cap for a metal pop-top beverage can. The cap attachment is formed of a liquid-impervious, elastically resilient material that has a skirt with a radially inwardly directed lip at its outer periphery and with a drinking port defined completely through its structure. The drinking port is spaced radially inwardly from the periphery of the cap attachment for alignment with the drinking opening in the pop-top beverage can. A collar having a radially outwardly directed flange is located on the underside of the cap coaxially about the drinking port. The cap fits onto the beverage can so that the lip of the skirt engages the bead at the top of the beverage can and so that the lower extremity of the collar projects through the drinking aperture in the top of the can. The flange at the lower extremity of the collar engages the underside of the top of the beverage can at the drinking opening therethrough. The lips of the user thereby avoid direct contact with the metal can as the user consumes the beverage from the metal can.

14 Claims, 4 Drawing Sheets

HYGIENIC BEVERAGE CAN ATTACHMENT

BACKGROUND OF THE INVENTION

1. Field of the Invention

The present invention relates to a device useful for attachment to the top of a beverage can to allow a person to hygienically drink from the can.

2. Description of the Prior Art

Numerous different types of drinks are sold for human consumption in beverage cans. Literally millions of cans of soft drinks, beer, iced tea, fruit juices and other beverages are sold annually and are consumed by millions of different people. Conventional beverage cans are often formed of aluminum, steel or some other metal in a generally cylindrical configuration with substantially flat tops and with a flat or slightly inwardly concave bottom. The beverage can top has a circular periphery which is rolled over the upper edge of the top of the cylindrical wall of the can. The periphery of the top and the upper edge of the wall of the can are rolled together and permanently deformed to form a peripheral bead about the top of the can.

In a conventional metal "pop-top" can an enclosed weakened area is formed in the top of the can a short distance in from the bead. The top of the can is equipped with an opening mechanism in the form of a lever attached to the center of the can at a fulcrum. The lever, when operated, presses the circumscribed, weakened area in the top of the can downwardly, thereby creating a drinking opening or aperture in the top of the can. This drinking opening is located a short distance in from the circumference of the can top.

In conventional practice a consumer lifts the beverage can to his or her lips once the opening in the top of the can has been created and drinks the beverage with his or her lips pressed against the area of the bead, a portion of the cylindrical can wall immediately adjacent thereto, and the top of the can adjacent to the drinking opening formed in the can top. While this is certainly an efficient and effective way to drink a beverage, this conventional practice has certain health hazards.

While originally manufactured and sealed under hygienic conditions, the exteriors of beverage cans are often exposed to dirt and unsanitary conditions from the time of manufacture until the beverage is actually consumed by the ultimate customer. Beverage cans are tightly sealed and the beverage therewithin is protected from contamination by the structure of the walls and top and bottom of the can until the can is opened. However, at that time a consumer is exposed to dirt, germs, bacteria, contamination and substances merely having an unpleasant taste once the consumer places his or her lips against the surface of the can. This exposure can lead to a common cold or even a more serious illness at times.

SUMMARY OF THE INVENTION

The present invention involves a personal, hygienic beverage can attachment that can be carried by a consumer and placed atop a beverage can when the consumer desires to drink from the can. The beverage can attachment is designed primarily for use with a top-top beverage can, but can also be used with beverage cans that are opened using a general purpose can opener. The attachment is small, very portable and may easily be cleaned. The hygienic attachment serves as a protective barrier between the lips of the person drinking from the can, and the surface of the beverage can. By utilizing the hygienic attachment a consumer is not exposed to ingestion of unsanitary contaminants that can collect on the surface of the beverage can as it travels through its channels of distribution until ultimately consumed.

In one broad aspect of the present invention may be considered to be a hygienic beverage can attachment comprising a generally disc-shaped cap formed of an elastically resilient, liquid-impervious material and having a periphery with an annular depending skirt. The skirt terminates in an annular, radially inwardly directed bead engaging lip. A drinking port is defined through the cap at a location radially inset from its periphery.

The cap has an exposed upper side and an opposite underside. Preferably the cap has an annular collar projecting from its underside at the drinking port defined therethrough. The collar defines an interior circular opening therewithin The port forms a circular opening in the upper side of the cap that is smaller than the interior diameter of the collar. The collar has a flange at its depending extremity and a neck that is located between the flange and the underside of the cap. The flange projects radially outwardly beyond the neck to define a gap at the neck of the collar between the flange and the underside of the cap. The gap is of a width just sufficient to receive the edges of the top of the can adjacent the ruptured area that defines the drinking opening in the top.

The cap of the invention is preferably comprised of a raised outer, annular rim that projects upwardly from the skirt at the periphery of the cap. This rim serves as a low dam that prevents liquid from spilling off of the top of the cap while a beverage is being consumed.

Also, the cap of the invention preferably has an inner, annular ring depending downwardly from its underside spaced radially inwardly a short distance from the skirt. This depending ring fits into the annular gutter that is normally formed just inside the bead that extends about the top of the can.

In another broad aspect the invention may be considered to be a beverage can attachment for use with a beverage can having a circular top with a peripheral bead and a rupturable region located radially inwardly from the bead. The rupturable region delineates the area of a drinking aperture. The attachment is comprised of a water impervious, elastically deformable cap having a circular outer perimeter, an upper exposed side and an opposite, lower underside. The cap has a downwardly projecting, annular skirt at its circular, outer perimeter. The skirt terminates in an annular, radially inwardly directed lip. A drinking opening is defined through the cap between its exposed side and its underside in alignment with the area of the drinking aperture of the top of the beverage can.

In still another aspect the invention may be described as a beverage can attachment comprising a cap form of a liquid-impervious, elastically resilient material having a structure with an exposed side and an underside defining a circular perimeter. The cap includes an annular peripheral skirt on its underside at its perimeter. The skirt has a radially inwardly directed annular lip. A drinking port is defined completely through the structure and extends between the exposed side and the underside thereof. The drinking port is spaced radially inwardly from the circular perimeter of the structure for alignment with a drinking opening in the top of the metal beverage can.

The invention may be described with greater clarity and particularity by reference to the accompanying drawings.

DESCRIPTION OF THE EMBODIMENT

Figure 1:
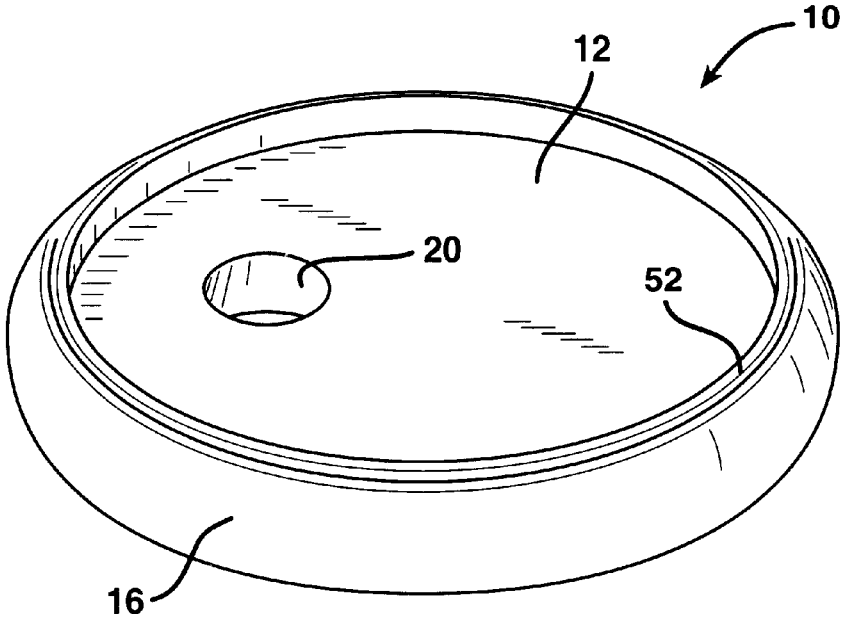
FIG. 1 is a perspective view of a preferred embodiment of the beverage can attachment, as seen from the top.
Figure 3:
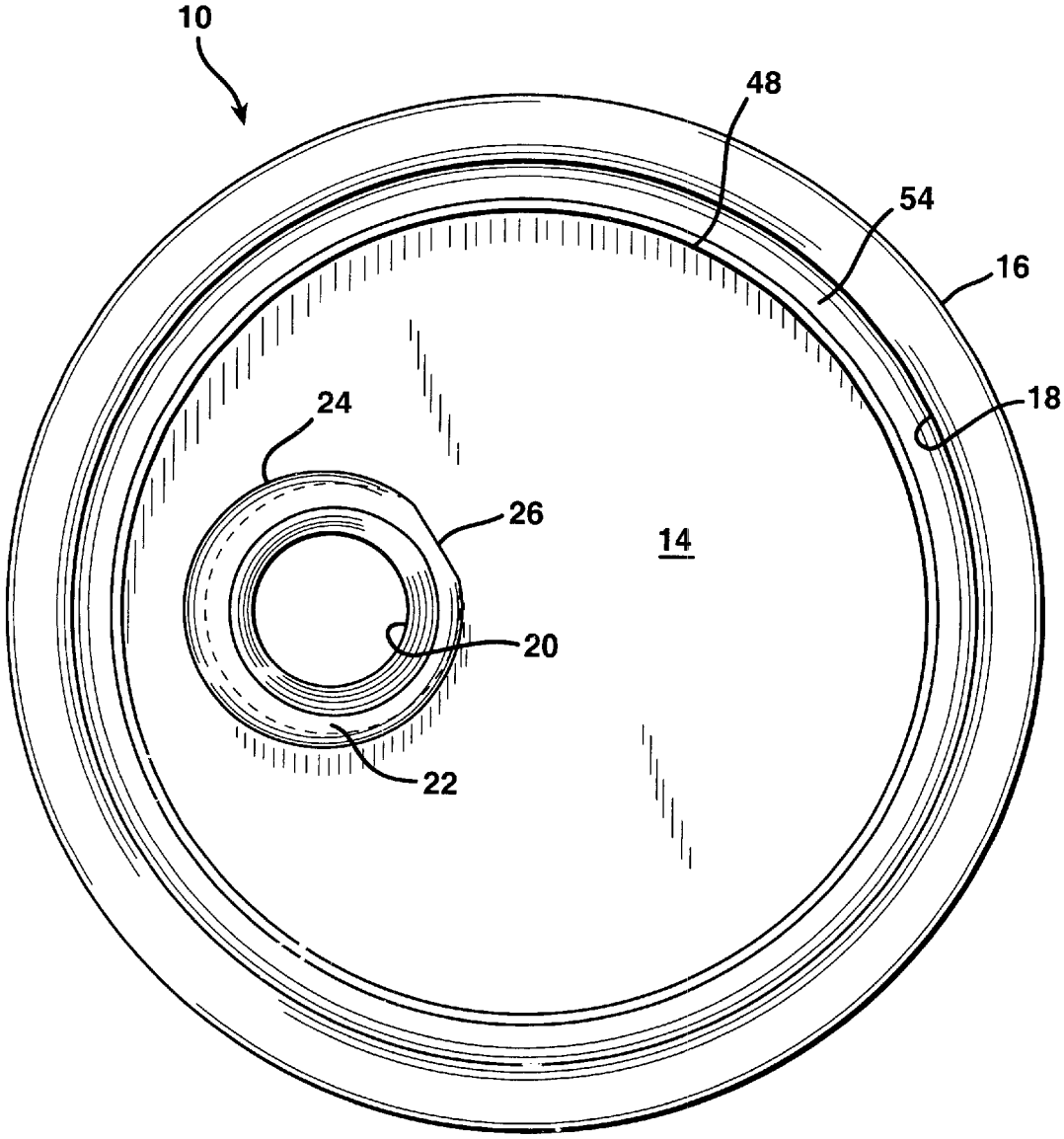
FIG. 3 Is a bottom plan view of the beverage can attachment of FIGS. 1 and 2.
Figure 4:
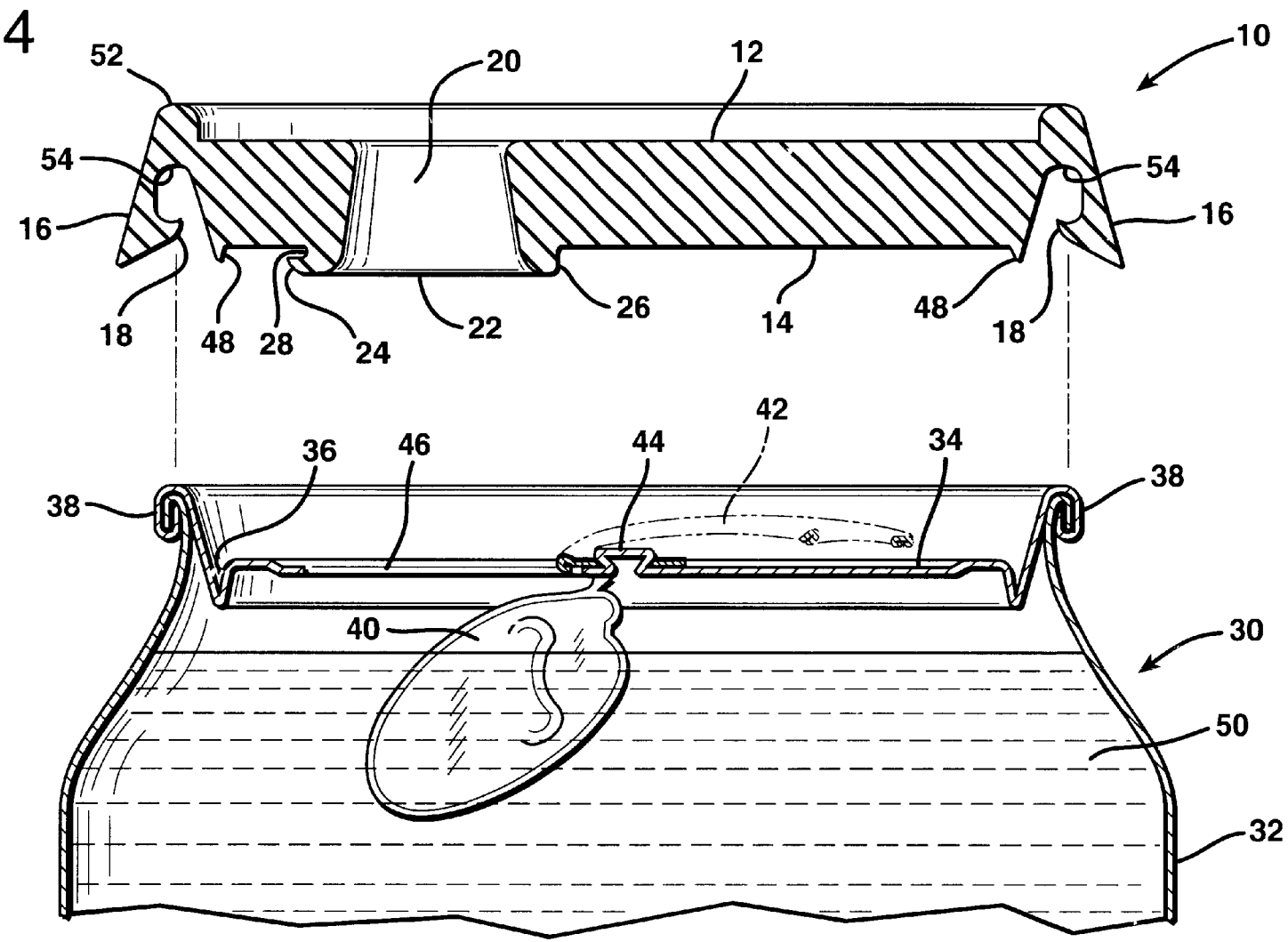
FIG. 4 is a sectional elevational view showing the beverage can attachment detached from a metal beverage can.

FIG. 1 illustrates a hygienic beverage can attachment 10 which is a structure formed as a generally disc-shaped cap from an elastically resilient, liquid-impervious material, which may be a nonporous thermoplastic or rubber. As best illustrated in FIGS. 1, 3, and 4, the cap 10 has a circular perimeter with an exposed upper side 12 having a circular face and a downwardly facing lower underside 14. The underside 14 of the cap 10 also has a circular face of slightly smaller diameter than the exposed upper side 12.

The beverage can attachment 10 is designed for use with a beverage container 30 which is of the conventional type in which soft drinks, beer, iced tea and other beverages are widely packaged for consumption in this country and throughout the world. The beverage container 30 is formed of thin gauge steel or aluminum and has an upright generally cylindrical wall 32 that is necked in slightly at its upper extremity. The beverage can 30 has a generally flat, disc-shaped top 34 that extends across the upper end of the cylindrical wall 32. Near its outer periphery the top 34 is deformed downwardly in an annular ring to define an annular gutter 36 having a generally V-shaped cross section. From the gutter 36 the outer periphery of the beverage can top 34 rises upwardly and outwardly. The peripheral extremity of the beverage can top 34 meets the upper extremity of the beverage can wall 32. These extremities are rolled over together to form an upper, outer, peripheral annular bead 38.

A generally oval shaped rupturable region 40 is delineated in the beverage can top 34 and extends radially to within a distance of between about one-quarter and one-half of an inch from the bead 38. The rupturable region 40 is originally formed by a die stamp that creates a weakened demarcation that nearly encircles the region 40 and delineates it from the surrounding structure of the beverage can top 34. The can top 34 is initially equipped with a pop-top tab lever 42 that is secured near one of its ends by an upwardly projecting protrusion 44 in the beverage can top 34. This protrusion 44 is forced through an opening in the pop-top tab 42 and flattened to form a conventional post to which the tab lever 42 is fastened. The protrusion 44 serves as a fulcrum for the tab lever 42.

When the beverage can top 34 is originally sealed over the beverage 50 within the can 30 the pop-top tab lever 42 is initially in the position indicated in phantom in FIG. 4. It remains in this position until the beverage can 30 is to be opened for consumption of the beverage 50 located therewithin. The free end of the pop-top tab lever 42 is then lifted and rotated in a counterclockwise direction from the position illustrated in FIG. 4. The shorter end of the pop-top tab lever 42 located close to the fulcrum post 44 is then forced downwardly against the weakened region of 40 of the beverage can top 34. The weakened region 40 is then punched out of the plane of the remaining structure of the beverage can top 34 downwardly into the interior of the can 30, as illustrated in FIG. 4. The rupture in the structure of the beverage can top 34 creates and delineates a drinking opening or aperture 46 once the weakened region and 40 has been forced downwardly to the position illustrated in FIG. 4. The structure and opening mechanism for the beverage container 30 is conventional, and need not be described in great detail.

The cap 10 has a downwardly depending annular skirt 16 at its outer circular perimeter. The skirt 16 surrounds the body of the cap 10 and at its lower extremity terminates in an annular, radially inwardly directed, bead engaging lip 18. A drinking port 20 is defined through the structure of the cap 10 at a location radially inset from the periphery of the cap, between one-half and one inch from the skirt 16. The drinking port 20 is completely surrounded by the structure of the body of the cap 10.

An annular collar 22 is defined at the underside 14 of the beverage can attachment 10 and projects downwardly from the underside 14 at the drinking port 20. At its downwardly projecting extremity the collar 22 is rounded and has a flange 24 projecting radially outwardly therefrom throughout an arc of its circumference of about 350 degrees. The remaining portion of the circumference of the lower extremity of the collar 22 is formed as a flat surface 26 by a chord across the extremities of the arcuate flange 24, as illustrated in FIG. 3.

The outer circumference of the collar 22 narrows to a neck 28 that is located between the flange 24 and the underside 14 of the cap 10. The intermediate portion of the collar 22 forming the neck 28 has an outer diameter smaller than that of the flange 24. With the formation of the neck 28 a narrow gap of about 1/32 of an inch is defined between the flange 22 and the underside 14 of the cap 10. This gap is no wider than the thickness of the gauge of a conventional aluminum top cop beverage can, such as the beverage can 30 illustrated in FIG. 4. The collar 20 is thereby configured for gripping the beverage can top 34 between the flange 24 and the cap underside 14 at the drinking opening 46 defined in the beverage can top 34.

Figure 5:
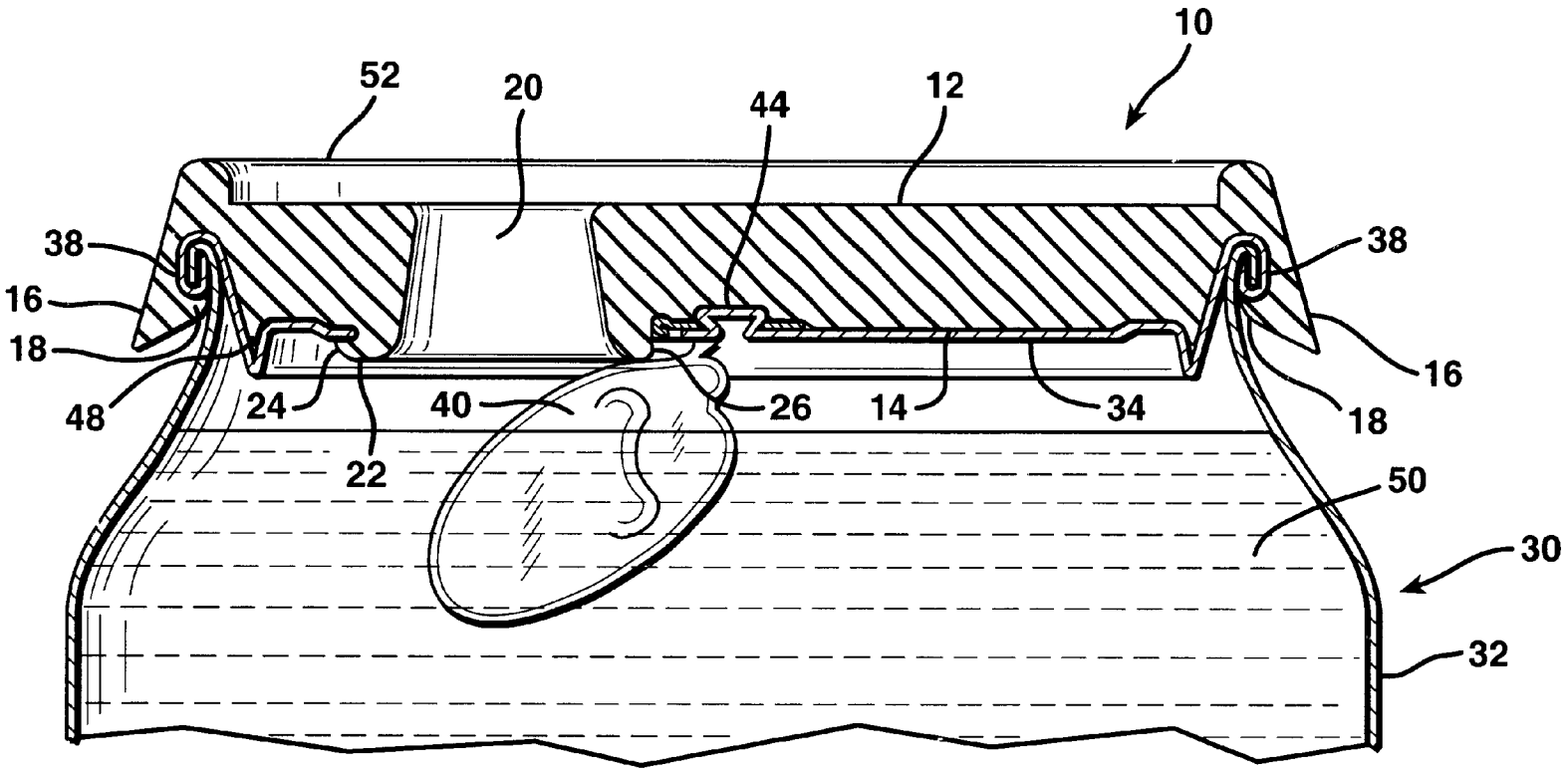
FIG. 5 is a sectional elevational view showing the beverage can attachment attached to a metal beverage can.

The drinking port or opening 20 formed in the hygienic beverage attachment 10 is aligned with the area of the drinking aperture 46 formed in the beverage can top 34. The drinking port 20 increases in cross-sectional area from the exposed side 12 to the underside 14 of the cap structure 10. The drinking port 20 in the cap 10 thereby has a generally frustoconical configuration, as illustrated in FIGS. 4 and 5. Therefore, the circular opening formed in the upper side 12 of the cap 10 by the port 20 is smaller in diameter than the interior diameter of the collar 22 projecting from the underside 14 of the cap 10.

Figure 2:
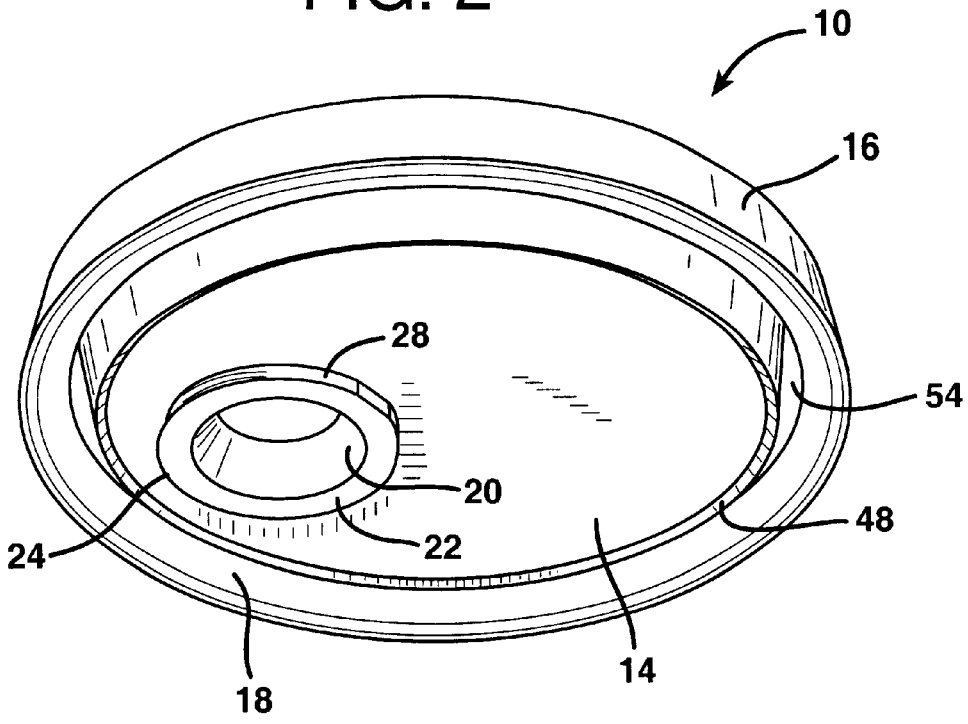
FIG. 2 is a perspective view of a preferred embodiment of the beverage can attachment, as seen from the bottom.

As illustrated in FIGS. 2, 4, and 5 the cap 10 is provided with an annular, downwardly depending ring 48 that encircles the undersurface 14 and which is spaced radially inwardly from the lip 18. The diameter of the depending ring 48 in the underside 14 of the cap 10 corresponds to the diameter of the gutter 36 defined in the outer periphery of the beverage can top 34. The depending ring 48 is spaced radially inwardly from the skirt 16 of the cap 10 and fits into the gutter 36 of the beverage can 30 when the cap 10 is releaseably engaged on the top of the beverage can 30, as illustrated in FIG. 5. The engagement of the ring 48 in the gutter 36 thereby aids in establishing a liquid tight seal between the cap 10 and the upper end of the beverage can 30.

The structure of the cap 10 defines an annular peripheral groove 54 in its underside 14. The groove 54 faces downwardly and has an outer boundary delineated by the skirt 16 and an inner boundary delineated by the circular, annular depending ring 48.

The beverage can attachment 10 also includes a raised, outer, annular rim 52 that projects upwardly from the skirt 16 at the periphery of the beverage can attachment 10. The upper extremity of the rim 52 is rounded for comfort on the lips of the consumer. The rim 42 serves as a low barrier or dam that prevents any liquid that may reach the upper surface 12 of the cap 10 from spilling when the cap 10 is engaged in position for drinking the beverage 50 as illustrated in FIG. 5. Liquid atop the upper surface 12 might otherwise spill out onto the face or clothing of the consumer as the beverage can 30 is tilted toward the consumer for consumption of the beverage 50.

The cap 10 is especially configured to releaseably engage the upper end of the beverage can 30 in sealing engagement therewith, as illustrated in FIG. 5. To engage the cap 10 on the beverage can 30 the cap 10 is oriented in a disposition parallel to the beverage can top 34 and pressed downwardly from the position illustrated in FIG. 4 to the position illustrated in FIG. 5. The undersurface of the lip 18 slopes upwardly and inwardly so that a cam action occurs that flexes the skirt 16 radially outwardly to elastically deform it as the undersurface of the lip 18 meets the bead 38. Once the inner edge of the lip 18 clears the bead 36, the resiliency of the structure forming the beverage can attachment 10 allows the skirt 16 to elastically return to its original configuration forming a liquid tight seal at the bead 38.

The annular collar 22 is configured to elastically flex radially inwardly to permit the flange 24 to pass through the drinking opening 46 as the cap 10 is pressed downwardly toward the beverage can top 34. The lower extremity of the flange 24 is rounded so that it readily deflects elastically radially inwardly to pass through the drinking opening 46 as the skirt 16 is concurrently being elastically flexed outwardly to clear the bead 38.

The top of the beverage can 30 is surrounded by the raised bead 38. The bead 38 fits into the annular groove 54 in sealing engagement therewith. As the annular groove 54 formed between the skirt 16 and the ring 48 engages the bead 38, the flange 24 clears the undersurface of the beverage can top 34 at the drinking opening 46 therethrough so as to resiliently engage the beverage can top 34 from beneath when inserted into the drinking opening 46. The flattened region 26 of the flange 22 avoids interference between the collar 22 and the attachment web by which the oval shaped region 40 is held to the underside of the remaining structure of the beverage can top 34. The gap formed at the neck 28 of the collar 22 is narrow enough so that the sheet metal forming the beverage can top 34 is gripped between the underside 14 of the body of the attachment 10 and the flange 24 at the edges of the drinking aperture 46 once the collar 22 has been inserted through the drinking aperture 46 and engaged with the top 34 of the beverage can 30. The collar 22 thereby holds at least an annular area of the underside of the beverage container attachment 10 surrounding the drinking port 20 compressed against the top 34 of the metal can 30 to form a liquid tight seal about the drinking opening 46 in the beverage can top 34 when the collar 22 is inserted into the drinking aperture 46.

The configuration of the skirt 16, the lip 18 and the flange 22 is such that the generally disc-shaped body of the cap 10 is held pressed against the upper surface of the metal beverage can top 34 and actually deforms slightly so as to follow the contours of the upper surface of the beverage can top 34, as illustrated in FIG. 5. The undersurface 14 of the beverage can attachment 10 elastically deforms to follow the configured surface of the beverage can top 34. Preferably, the pop-top tab 42 is removed from the beverage can top 34 prior to engagement of the cap 10 upon the beverage can 30 so as to facilitate sealed engagement between the undersurface 14 of the cap 10 and the upper surface of the beverage can top 34, as illustrated in FIG. 5.

It can be seen that the beverage container accessory 10 forms a personalized, hygienic attachment that a consumer can releaseably engage on a conventional beverage can 30 to prevent the imbibation of contaminants that may reside upon the can 30. Once the user has finished consuming the beverage from the can 30 the attachment 10 can be removed by distending the skirt 16 at a selected location along the bead 38, preferably at a location diametrically opposite the drinking aperture 46. The attachment 10 can be pulled free from the can 30 using the portion of the bead 38 located diametrically opposite the distended portion of the skirt 16 as a fulcrum. The flattened portion 26 of the collar 20 thereby clears the drinking aperture 46 first, thus minimizing abrasion and degradation of the radially extending flange 22. The user can then wash or otherwise clean the beverage can attachment 10 for reuse at his or her convenience.

Undoubtedly, numerous variations and modifications of the invention will become readily apparent to those familiar with beverage packaging. For example, the beverage can attachment can be formed of compressible polyurethane foam having an exterior skin or it can be formed of an incompressible substance. The beverage can attachment can be formed with or without a collar. Accordingly, the scope of the invention should not be construed as limited to the specific embodiment depicted and described, but rather is defined in the claims appended hereto.

I claim:

1. A hygienic beverage can attachment comprising a generally disc-shaped cap formed of an elastically resilient, liquid-impervious material and having a periphery with an annular depending skirt that terminates in an annular, radially inwardly directed bead engaging lip, and a drinking port is defined through said cap at a location radially inset from said periphery thereof and further comprising an annular collar projecting from said underside of said cap at said drinking port therethrough wherein said collar has a flange at its extremity and a neck located between said flange and said underside of said cap, and said flange projects radially outwardly beyond said neck, whereby a gap is defined between said flange and said underside of said cap.

2. A beverage can attachment according to claim 1 wherein said collar defines an interior circular opening therewithin and said port forms a circular opening in said upper side of said cap that is smaller than the interior diameter of said opening defined by said collar.

3. A beverage can attachment according to claim 1 further comprising a raised, outer, annular rim projecting upwardly from said skirt at said periphery of said cap.

4. A beverage can attachment according to claim 1 further comprising an inner, annular rim depending downwardly from said cap and spaced radially inwardly from said skirt.

5. A beverage can attachment according to claim 1 wherein said cap is comprised of a nonporous plastic.

6. A beverage can attachment for use with a beverage can having a circular top with a peripheral bead and a rupturable region located radially inwardly from said bead delineating the area of a drinking aperture, said attachment comprising a water impervious, elastically deformable cap having a circular outer perimeter, and an upper exposed side and an opposite lower underside, a downwardly projecting annular skirt at said circular, outer perimeter terminating in an annular, radially inwardly directed lip, and a drinking opening defined through said cap between said exposed side and said underside in alignment with said area of said drinking aperture of said top of said beverage can, and further comprising a downwardly depending collar extending from said underside of said cap and encircling said drinking opening therethrough, wherein said collar is formed with a radially outwardly projecting flange at its extremity and an intermediate portion forming a neck having an outer diameter smaller than that of said flange, whereby a gap exists between said flange and said underside of said cap so that said collar is configured for gripping said top of said beverage can at said drinking aperture.

7. A beverage can attachment according to claim 6 further characterized in that said cap is resiliently compressible so that it is held in contact with said top of said beverage can when said collar grips said top of said beverage can.

8. A beverage can attachment according to claim 7 further comprising an inner, annular ring depending from said underside of said cap for residing in contact with said top of said beverage can throughout the circumference thereof adjacent said beverage can bead.

9. A beverage can attachment according to claim 6 wherein said flange is formed as an annular structure with a segment missing therefrom to provide clearance for said rupturable region of said beverage can top when said collar grips said top of said beverage can.

10. A beverage can attachment comprising a cap formed of a liquid-impervious, elastically resilient material having a structure with an exposed side and an underside and defining a circular perimeter including an annular, peripheral skirt at said perimeter on said underside with a radially inwardly directed annular lip projecting from said skirt, a drinking port defined completely through said structure and extending between said exposed side and said underside thereof, wherein said the drinking port is spaced radially inwardly from said circular perimeter of said structure for alignment with a drinking opening in the top of a metal beverage can and further comprising a radially flanged collar that surrounds said drinking port on said underside of said cap structure, and said collar is configured to elastically flex radially inwardly to pass through said drinking opening of said metal beverage can so as to releaseably engage said top of said metal beverage can from beneath when inserted into said drinking opening.

11. A beverage can attachment according to claim 10 wherein said top of said metal beverage can is encircled by a raised, annular bead, and said structure of said cap defines an annular groove in its underside having an outer boundary delineated by said skirt and an inner boundary delineated by a circular, annular depending rim.

12. A beverage can attachment according to claim 10 wherein said drinking port increases in cross-sectional area from said exposed side to said underside of said cap structure.

13. A beverage can attachment according to claim 10 wherein said structure of said cap defines a raised, annular rim about the periphery of its exposed side.

14. A beverage can attachment according to claim 10 further comprising an annular, peripheral groove in said underside of said structure of said cap, and said top of said beverage can top is surrounded by a raised bead that fits into said annular groove in sealing engagement therewith.

* * * * *